United States Patent [19]

Taylor

[11] 4,268,984

[45] May 26, 1981

[54] SIGN ASSEMBLY

[76] Inventor: Warren A. Taylor, 4025 - 11th Ave. South, Minneapolis, Minn. 55407

[21] Appl. No.: 71,848

[22] Filed: Sep. 4, 1979

Related U.S. Application Data

[63] Continuation-in-part of Ser. No. 836,381, Sep. 26, 1977, abandoned.

[51] Int. Cl.[3] ..... A47G 1/06; G09F 1/12

[52] U.S. Cl. ..... 40/154; 40/156

[58] Field of Search ..... 40/152, 152.1, 154, 40/155, 156, 158 R, 158 B, 571, 611, 201, 202, 209, 602, 603, 157

[56] References Cited

U.S. PATENT DOCUMENTS

| | | | |
|---|---|---|---|
| 1,094,709 | 4/1914 | Faucett | 40/152 |
| 1,468,198 | 9/1923 | Dunn, Jr. | 40/306 |
| 1,904,318 | 4/1933 | Lehere | 40/154 |
| 2,018,528 | 10/1935 | Marsh | 40/16 |
| 2,027,790 | 1/1936 | Schneider | 40/606 |
| 2,055,201 | 9/1936 | Leigh | 40/539 |
| 2,507,937 | 5/1950 | Slavsky et al. | 40/16 |
| 2,730,825 | 1/1956 | Wilds | 40/10 |
| 2,824,398 | 2/1958 | Storm | 40/155 |
| 2,860,437 | 11/1958 | Carroll | 40/152 |
| 2,935,804 | 5/1960 | Duckro | 40/10 |
| 2,961,789 | 11/1960 | Hughes | 40/152 |
| 2,968,108 | 1/1961 | Knox | 40/152 |
| 2,971,282 | 2/1961 | Petrey | 40/152 |
| 3,041,761 | 7/1962 | Knox | 40/152 |
| 3,041,762 | 7/1962 | Knox | 40/152 |
| 3,090,145 | 5/1963 | Goyke | 40/152 |
| 3,460,282 | 8/1969 | Swirsky | 40/152 |
| 3,553,872 | 1/1971 | Ebner | 40/152 |
| 3,613,279 | 10/1971 | Belfor | 40/152 |

*Primary Examiner*—John F. Pitrelli
*Assistant Examiner*—G. Lee Skillington
*Attorney, Agent, or Firm*—Kinney, Lange, Braddock, Westman & Fairbairn

[57] ABSTRACT

A rectangular sign frame assembly presenting opposing side walls having undercut lips at their upper edges, which receive corresponding edges of a deflectable elastic sign to hold the latter in assembled relation to the frame. The sign may be removed by bowing the same further inwardly to expose a hidden recess into which a tool can be inserted for prying the sign loose. The sign assemblies may also have a deflection inhibitor which limits such further inward deflection of the sign, preventing removal by unauthorized persons and which may be moved into a position allowing such deflection and removal of said sign.

19 Claims, 17 Drawing Figures

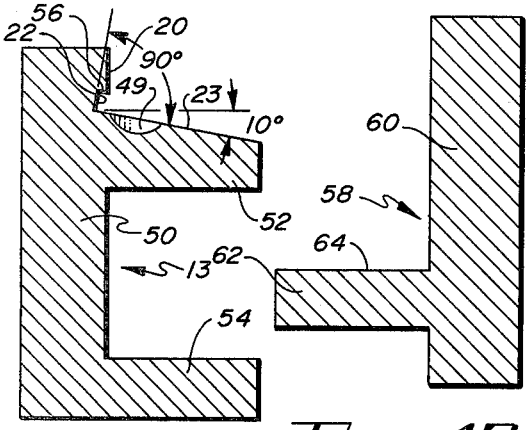
FIG. 11
FIG. 12
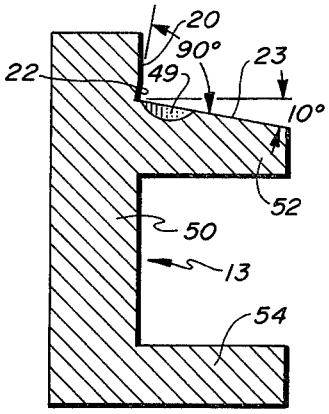
FIG. 10
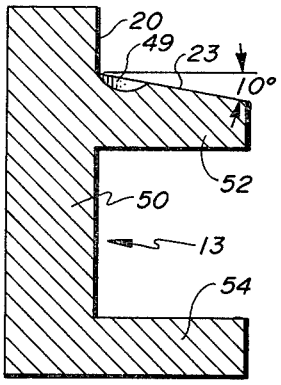
FIG. 9
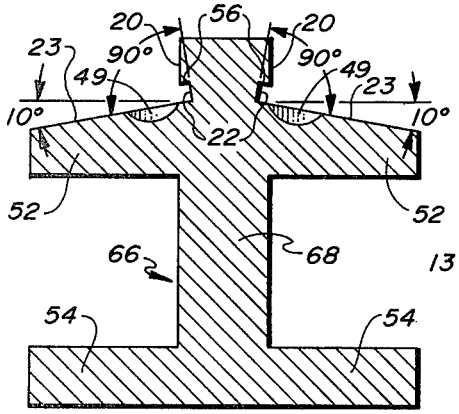
FIG. 13
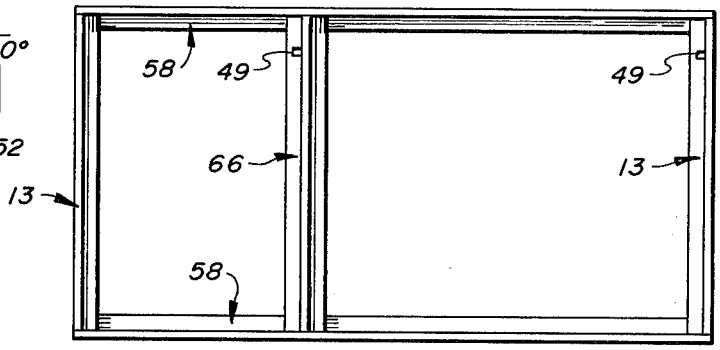
FIG. 14
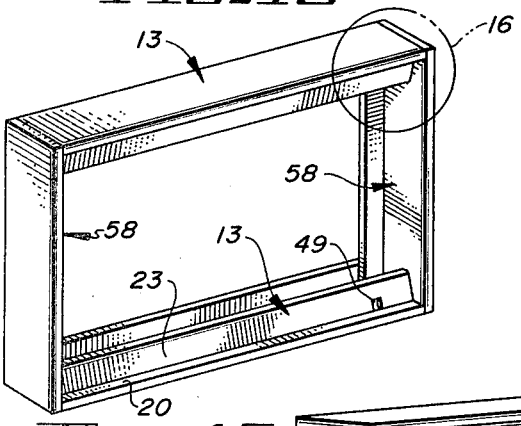
FIG. 15
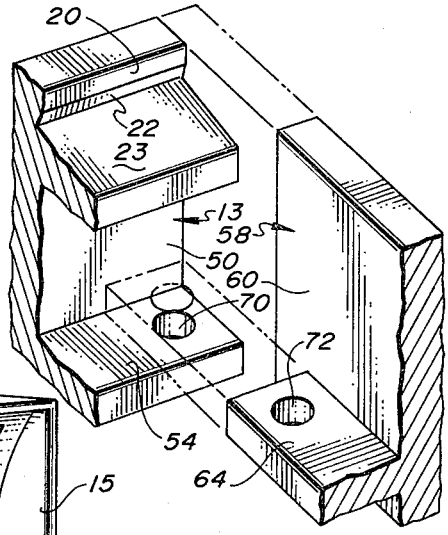
FIG. 16
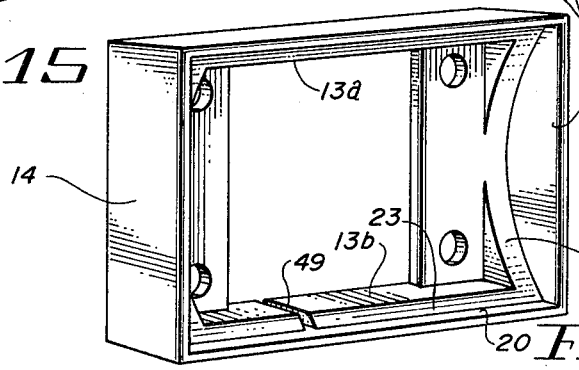
FIG. 17

SIGN ASSEMBLY

REFERENCE TO CO-PENDING APPLICATION

The present application is a continuation-in-part of U.S. patent application Ser. No. 836,381, filed Sept. 26, 1977 by Warren A. Taylor, now abandoned.

BACKGROUND OF THE INVENTION

1. Field of the Invention

The present invention relates to sign assemblies including a quadrilateral frame in which the sign element is detachably mounted. In particular, the present invention relates to a sign assembly mounted in an inwardly bowed position in such a frame.

2. Description of the Prior Art

It is extremely desirable to have a sign frame assembly wherein the sign element can be easily removed and replaced by another. This is extremely important in public exhibition places such as theaters and zoos that change their shows periodically or want to have the capability of emphasizing different features during different seasons. The sign frame assembly must therefore have the capability of allowing the sign element to be easily removed and replaced by another sign element and yet hide the manner in which the sign element is placed within the frame assembly from the viewing public so that unauthorized persons may not remove the sign element.

The prior art is replete with sign assemblies comprising holders with replaceable sign elements. However, these devices are of such construction that the sign can be removed with little ingenuity. One such example is included in the Wilds U.S. Pat. No. 2,730,825 wherein an elongated molding has undercut top and bottom lips which engage an outwardly bowed flexible sign element. The removal of the sign element is accomplished by a person grasping opposite edge portions of the sign element with thumb and forefinger.

In another sign assembly shown in the Duckro U.S. Pat. No. 2,935,804, the main body of the molding is concave in construction and the sign element is deflected inwardly into the curved concave formation. A groove running longitudinally behind the sign element and in the elongated molding allows a person to pull the sign element by grasping the sign element in front of the groove and pulling it out into a convex position and disengaging the sign element from the holder.

The Knox U.S. Pat. No. 3,041,761 shows a frame assembly wherein the flexible sign element is inserted into grooves of opposing sides. The sign element may be flexed either into a concave or convex position for a viewing effect. When flexed into the convex position, the viewing public may easily discern the engaging relationship between the flexible sign element and the frame and remove the sign element. When flexed into the concave position to hide the manner of mounting, the flexible sign element is hard to remove since the opposing edges of the sign element are placed deeply within the grooves of the opposing frame members.

The Swirsky U.S. Pat. No. 3,460,282 shows a device that holds opposing edges of photographs within grooves. The device has only two frame members and the photographs are slid into the grooves of the frame members. The manner in which the photograph is mounted is not hidden and would be obvious to the viewing public if the device was used as a sign frame assembly.

SUMMARY OF THE INVENTION

The present invention is a sign frame assembly that holds a flexible sign element that is easily removed and mounted while the manner of mounting is hidden from the viewing public. The sign frame assembly includes four frame portions in a quadrilateral relationship which are either integral with each other or fixedly attached to each other, forming the sign frame. Two opposing frame portions have a first sign engaging surface and a second sign engaging surface in which the second sign engaging surface is inclined with respect to the plane of the sign frame assembly. The second sign engaging surfaces extend inwardly into the frame assembly. The first sign engaging surfaces are spaced apart by a distance slightly less than the corresponding dimension of the sign so that when a flexible sign is secured between the first sign engaging surfaces, it is bowed inwardly towards the second sign engaging surfaces.

In mounting the inwardly bowed sign, opposing edges of the sign are placed against the first sign engaging surfaces and the sign is pushed in an inwardly bowed position with respect to the sign frame assembly. When in an inwardly bowed position the back surface of the sign element approaches but does not engage the second sign engaging surfaces over any substantial portion of their width. In removing the flexible sign element, the sign element is deflected further inwardly against the second sign engaging surface to cause the opposing edges of the sign element to move away from their engaging relationship with the first sign engaging surfaces to allow the removal of the sign element.

The sign frame assembly may also have a niche in one of the two second sign engaging surfaces. When the flexible sign element is deflected inwardly for removal, the niche will be exposed, allowing a tool to be inserted into the niche and engage the back of the flexible sign element, facilitating the removal thereof.

The sign frame assembly also may include a deflection inhibitor in a frame portion other than the frame portions having the first and second sign engaging surfaces. The deflection inhibitor limits the inward deflection of the flexible sign assembly, preventing a curious viewing public from accidentally deflecting the flexible sign element inwardly and exposing the manner of mounting. The deflection inhibitor is of a type that has a deflection inhibiting position and a position that allows deflection. A tool is used to move the deflection inhibitor from one position to the other.

The portions of the frame may either be formed as an integral structure or may be separate members. In one form, the frame portions are extruded from an extrudable material such as aluminum. The elements may be formed with internally extending flanges which provide the second sign engaging surfaces and means for securing the frame members together.

Other features and objects of the invention will be apparent from a consideration of the accompanying specification, claims and drawing.

BRIEF DESCRIPTION OF THE DRAWINGS

FIG. 9 is a cross-sectional view of another embodiment of a frame portion having the first and second sign engaging surfaces;

FIG. 10 is a cross-sectional view of a modification of the frame portion of FIG. 9 showing the part of the first sign engaging surface that directly engages the sign element forming a 90° angle with the second sign engaging surface;

FIG. 11 is still another modification of the frame member of FIGS. 9 and 10 wherein the portion that directly engages the sign element is extended inwardly beyond the plane of the side wall so that the first sign engaging surface is in the form of a recess for engaging the sign element;

FIG. 12 is a cross-sectional view of the other frame portion that forms part of the sign frame assembly;

FIG. 13 is a cross-sectional view of a frame member used in frame assemblies that maintain a plurality of flexible sign elements;

FIG. 14 is an elevational view of a sign frame assembly capable of maintaining two flexible sign elements;

FIG. 15 is a perspective view of another embodiment of the sign frame assembly using the frame members of FIGS. 9 and 12;

FIG. 16 is a fragmentary perspective view take along the broken circle line 16 of FIG. 15 with the frame members separated to show the manner of engagement of the frame members; and FIG. 17 is a perspective view of still another embodiment of the sign frame assembly molded from a plastic material.

DETAILED DESCRIPTION OF THE PREFERRED EMBODIMENTS

Figure 1:
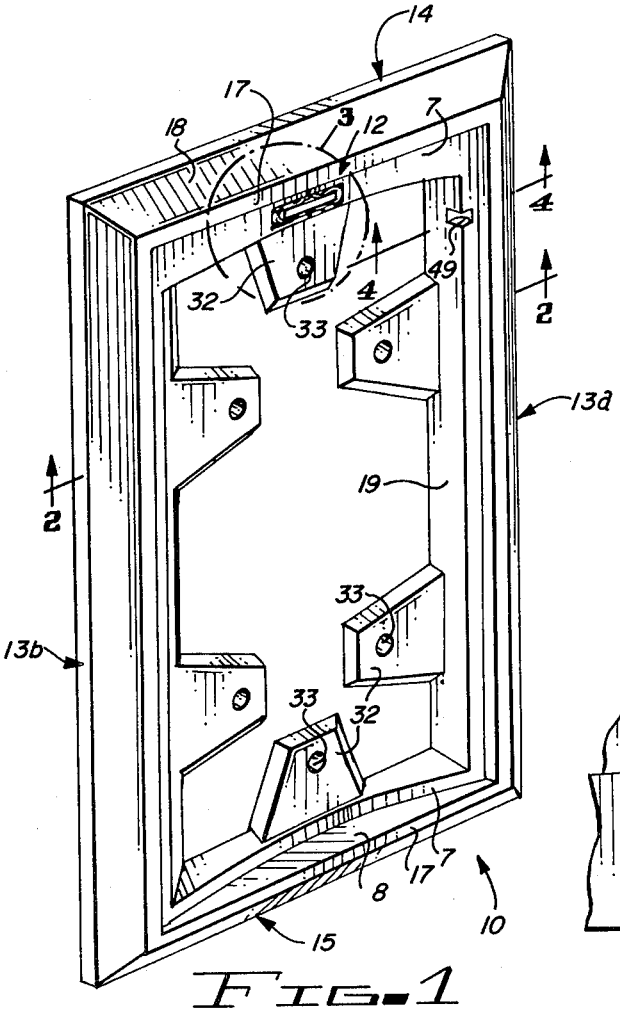
FIG. 1 is a perspective view of one embodiment of the sign frame assembly of the present invention in which there is a deflection inhibitor.
Figure 2:
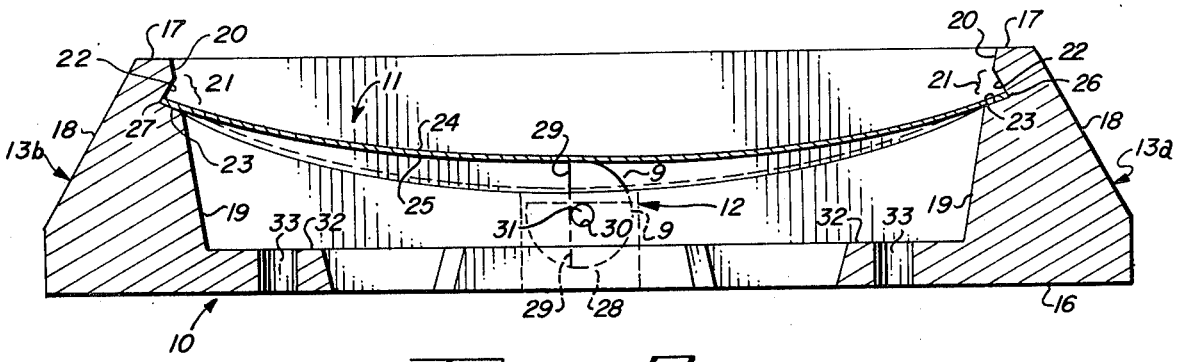
FIG. 2 is a cross-sectional view taken along the line 2—2 of FIG. 1 showing the inwardly bowed position of the flexible sign element and its relation to the deflection inhibitor.

Referring now to the drawings, wherein like reference characters denote corresponding elements throughout the several views, and first more particularly to FIGS. 1 and 2, the sign frame assembly of the present invention is shown generally at 10. The sign frame assembly 10 includes first and second frame members 14, 15, respectively, and third frame member 13*a* and fourth frame member 13*b*. Referring now more particularly to the preferred embodiment of FIG. 2, each of the frame members has a bottom surface 16 and a top surface 17 which is narrower than bottom surface 16. The outer edges of surfaces 16 and 17 are connected by outer inclined surfaces 18. Inner inclined surfaces 19 of the third and fourth frame members 13*a* and 13*b* extend upwardly and outwardly from the upper surface of the bottom wall including surface 16 to a flexible sign element 11. Inner surfaces 8 of the first and second frame members 14 and 15 are substantially flat and extend from top surfaces 17 to concave shoulders 7.

Figure 4:
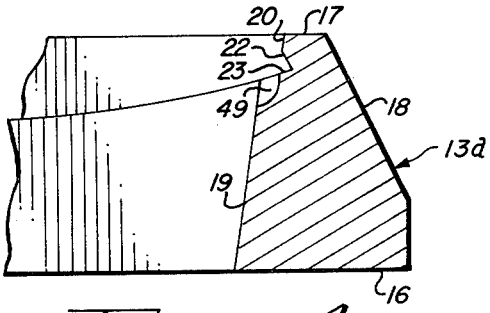
FIG. 4 is a fragmentary cross-sectional view, on an enlarged scale, taken along the line 4—4 of FIG. 1.

The third and fourth frame members 13*a*, 13*b* have a first sign engaging surface 22 and a second sign engaging surface 23, as best seen in FIGS. 2 and 4. The second sign engaging surface 23 is inclined inwardly and downwardly with respect to the plane of the sign frame assembly 10. In the embodiment shown in FIGS. 2 and 4, there is a relatively wide groove 21, defined by the first sign engaging surface 22. An inwardly inclined wall 20 extends downwardly from the top surface 17 to the groove 21. The sign engaging surface 22 of the groove 21 is preferably normal to the second sign engaging surface 23.

The flexible sign element 11 is slightly greater than the distance between the first sign engaging surfaces 22 of the third and fourth frame members 13*a*, 13*b* and has a front face 24 and a rear face 25. The sign element 11 also has edges 26, 27 which engage the first sign engaging surfaces 22 of the third and fourth frame members 13*a* and 13*b*, respectively.

In FIG. 1, the frame members are preferably shown to have mounting tabs 32. Openings 33 provided in the mounting tabs 32 receive fastening devices such as screws or bolts to fasten the sign frame assembly of the present invention to a support (not shown).

Figure 3:
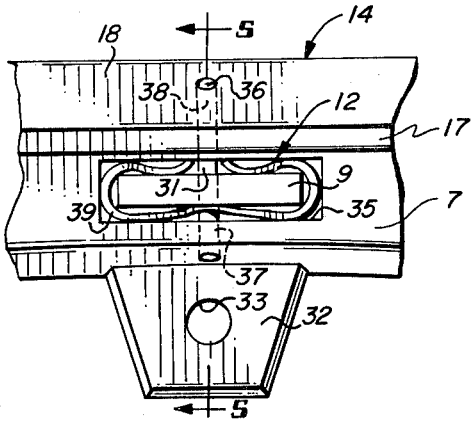
FIG. 3 is a fragmentary elevational view on an enlarged scale of the area enclosed in broken line circle 3 of FIG. 1.
Figure 5:
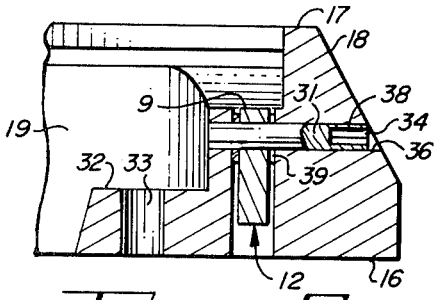
FIG. 5 is a cross-sectional view, on an enlarged scale, taken about the plane of line 5—5 of FIG. 3.

In the embodiment shown in FIGS. 1 through 6, there is a deflection inhibitor 12. This inhibitor is shown as including a cam-like member 9, having an arcuate surface 28, a flat surface 29, and an opening 30, by which the member 9 may be drivably mounted on a shaft 31, as best seen in FIGS. 2, 3 and 5.

FIG. 3 preferably shows a recess 35 entering the concave shoulder 7 of the frame member 14. Preferably journal openings 36 are formed in the first frame member 14 on opposite sides of the recess 35. The shaft 31 is journalled in openings 36. The inner end 37 of the shaft 31 projects beyond the inner surface of the first frame member 14 and is provided with some means of retaining the shaft 31 in position with respect to the first frame member 14, such as a nut or cotter pin (not shown). The outer end 38 of the shaft 31, as best seen in FIG. 5, is formed with a socket recess 34, as typified by an Allen head wrench.

Figure 6:
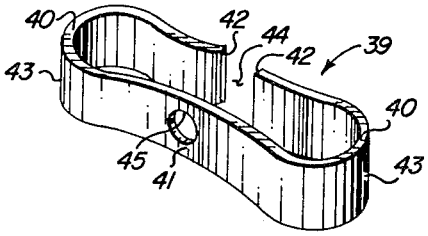
FIG. 6 is a perspective view, on an enlarged scale, of the deflection inhibitor spring, per se.

A leaf spring, designated generally at 39 in FIG. 6, is positioned in recess 35, as best seen in FIG. 3, to generate friction on the cam-like member 9, holding the latter in an adjusted position. The leaf spring 39 includes two U-shaped parts 40 which are joined by a leg of one part being integral with the corresponding leg of the other part, as depicted at a point of confluence 41. The spring 39 has two ends 42 which bear against an inner face of the recess 35, as shown in FIG. 3.

Each U-shaped part 40 includes a bowed back 43 and engages an end surface of the recess 35. Two legs of the U-shaped parts 40 terminate in ends 42 and are bowed inwardly to press against a face of the cam-like member 9. Similarly, the opposite legs, joined at the point of confluence 41, are bowed inwardly to bear against the cam-like member 9. The ends 42 are spaced apart by a gap 44. An aperture 45 is formed in the area of confluence 41. The gap 44 and the aperture 45 receive the shaft 31.

Figure 7:
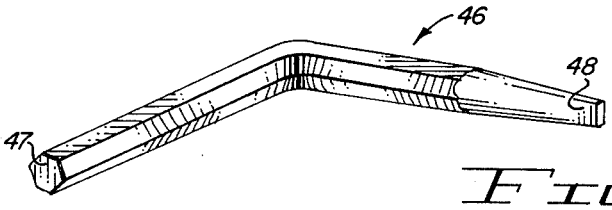
FIG. 7 is a perspective view of one embodiment of the tool used for moving the deflection inhibitor from one position to another and for facilitating the removal of the flexible sign element.

FIG. 7 shows one embodiment of a tool, designated generally at 46, used to engage the socket recess 34 with an end 47. It should be understood, however, that the end 47 is made to conform to the particular configuration that the socket recess 34 assumes. An end 48 is used to engage niche 49 to facilitate removal of the flexible sign element 11, as will be described later.

The deflection inhibitor 12 and the leaf spring 39 may be assembled in the recess 35 in any preferred way, depending on the structural features of the cam member 9 and shaft 31, in order to obtain a drivable relation. One method would be to use a key or a key-way, which is well known and not herein shown or described. While assembly of the deflection inhibitor 12 may vary, one method would be to insert the leaf spring 39 into the recess 35, so that the leaf spring 39 will bear against the walls of the recess 35. Cam-like member 9 is then placed within the leaf spring 39 and held in an adjusted position by the tension exerted by the leaf spring 39. This results in the alignment of the opening 36 of the first frame member 14, aperture 45 and the gap 44 of the leaf spring 39, and the opening 30 of the cam-like member 9. The shaft 31 is then passed through said openings and retained by appropriate means (not shown).

The position of the cam-like member 9 for the installation and removal of the sign element 11 from the sign frame assembly 10 is shown in FIG. 2. To inhibit the deflection of the flexible sign element 11, the flat surface 29 of the cam-like member 9 is substantially perpendicular to the rear face 25 of the flexible sign element 11. For removal of the flexible sign element 11, the end 47 of the tool 46 is inserted into the socket recess 34 of the shaft 31 and the cam-like member 9 is rotated to the position shown in broken lines. In this position, the flat surface 29 is substantially parallel to the rear face 25 of the flexible sign element 11.

Figure 8A:
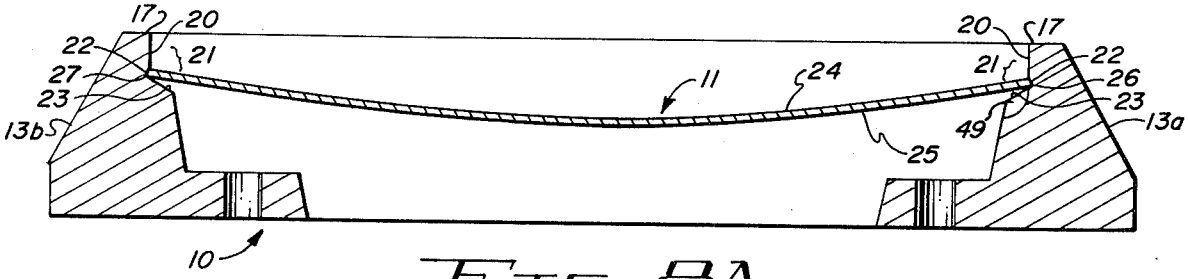
FIG. 8A is a cross-sectional view, somewhat diagrammatic, of a modified form of the frame assembly with the opposing frame elements engaging the flexible sign element in an inwardly bowed position.
Figure 8B:
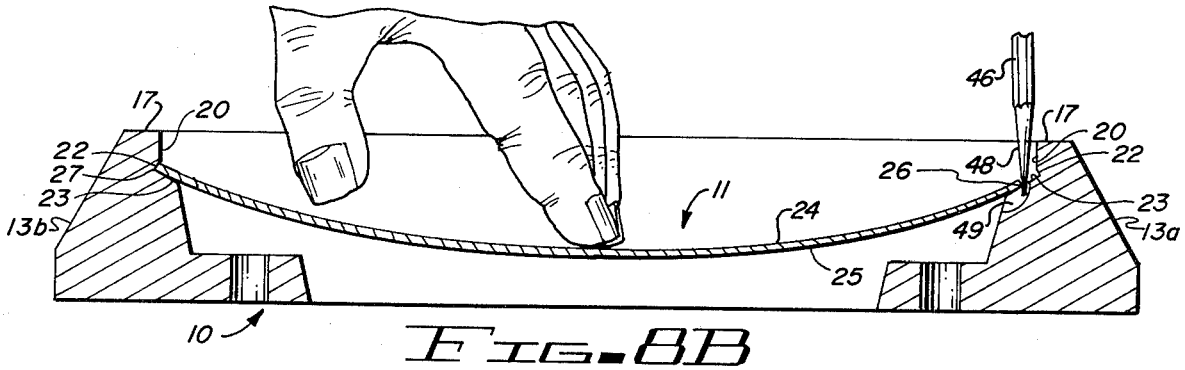
FIG. 8B is a view, similar to FIG. 8A, demonstrating the inward deflection of the flexible sign element and the insertion of the tool into the niche of the side wall.
Figure 8C:
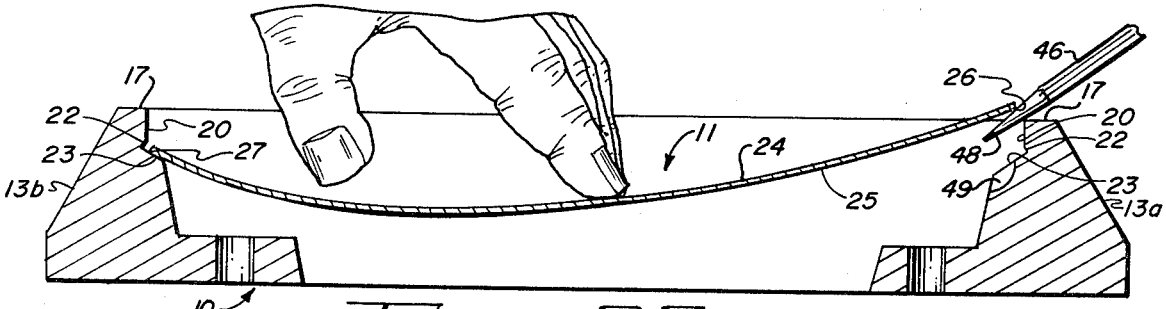
FIG. 8C is a view, similar to FIGS. 8A and 8B, showing the sign element being removed out of the frame assembly, the removal being facilitated by the tool.

FIGS. 8A, 8B and 8C demonstrate the mounting and the removal of the flexible sign element 11 in connection with a slight modification of the frame assembly. In this form of the frame assembly, the walls 20 extend vertically down to the first sign engaging surfaces 22. The flexible sign element 11 being slightly larger than the distance between the first sign engaging surfaces 22 of the third and fourth frame members 13*a*, 13*b*, is deflected inwardly and snapped into place with the edges 26, 27 engaging the first sign engaging surfaces 22, as shown in FIG. 8A. In this position, the sign element engages the second sign engaging surfaces 23 only near their outer extremities. The sign element is spaced from the second sign engaging surfaces over most of their extent. Since the sign engaging surfaces 22 are normal to the second sign engaging surface 23, this facilitates in holding the flexible sign element 11 in the bowed position.

The flexible sign element 11 is removed by first deflecting it inwardly as shown in FIG. 8B. This brings the sign element into engagement with the second sign engaging surfaces 23 over their full extent. Further inward deflection of the sign causes the outer portions of the sign to move inwardly along the second sign engaging surfaces to expose either edge 26 or 27 or both. FIG. 8B further shows a method that facilitates the removal of the flexible sign element 11 when being bowed inwardly. The tool 46 shown in FIG. 7 has an end 48 that is inserted into the niche 49 in the surface 23 to engage the rear face 25 of the flexible sign element 11. Once the flexible sign element 11 is deflected inwardly sufficiently to move edge 26 over the niche 49, the latter is exposed and the end 48 of the tool is inserted therein. The tool 46 is then used as a lever, as shown in FIG. 8C, to engage the rear face 25 of the flexible sign element 11. Thus, removal of the flexible sign element 11 is effected. It should be understood that the niche 49, while highly desirable, would not always be necessary for the removal of the flexible sign element and that instead of the tool 46 any pointed object that is capable of being inserted into the niche 49 may be used. Niche 25 is preferably relatively narrow so as to be relatively inconspicuous and to require a tool that is relatively narrow.

FIG. 9 displays another embodiment, in cross-sectional view, of the third and fourth frame members of the present invention, generally indicated at 13.

The frame member 13, in the form shown in FIGS. 9 through 11, is extruded from some material such as aluminum. The frame member 13, in the form shown in FIG. 9, has a side element 50 and integral, inwardly extending flanges 52 and 54. The top flange 52 provides the second downwardly inclined sign engaging surface 23 and the niche 49 is formed in the upper surface of this flange. The bottom flange 54 is used for assembling the frame and for mounting the same, as will be described later. The first sign engaging surface is provided by the lower portion of the inner upper wall 20 of the side element 50. The angle of inclination of the upper surface of flange 52 forming the second sign engaging surface 23 is preferably about 10° with respect to the horizontal plane of the frame. Inclinations of up to 50° have been found satisfactory, however.

FIG. 10 shows still another embodiment of the third and fourth frame members generally indicated at 13 similar to the embodiment in FIG. 9. The frame member 13 of FIG. 10 also contains side element 50, upper flanges 52 and bottom flanges 54 with a first sign engaging surface 22 and a second sign engaging surface 23 inclined to the plane of the sign frame assembly. The first sign engaging surface 22 is preferably inclined inwardly with respect to wall 20 to facilitate the retention of the flexible sign element 11. The surface 23 is disposed at a 90° angle with the second sign engaging surface 23 and has been found to hold the flexible sign element 11 more securely.

FIG. 11 shows still another embodiment of the third and fourth frame members generally indicated at 13 similar to the embodiment shown in FIGS. 10 and 9. The frame member 13 in FIG. 11 has the first sign engaging surface 22 recessed into the wall 20. The surface 23 again is disposed at a 90° angle with the second sign engaging surface 23 and the recess is defined by the second sign engaging surface 23 and a top surface 56. The second sign and top surface 56 are spaced apart at least the thickness of the flexible sign element. In this embodiment, the flexible sign element 11 has been found to be held even more securely than in the embodiment of FIG. 10 and is advantageous in situations where such security is warranted.

FIG. 12 shows another embodiment of frame members 14, 15 that is extruded from such a material as aluminum. It is designed to be used with frame members 13 of the type shown in FIGS. 9 through 11, which have just been described. The frame member of FIG. 12, generally indicated by the numeral 58, has a side element 60 and a lower inwardly extending flange 62. The flange 62 has an upper surface 64 which has the purpose of limiting the maximum amount of inward bowing that the flexible sign element may be bowed inwardly. It should be understood that the flexible sign element 11 does not engage surface 64 in its normal bowed position within the sign frame assembly. Surface 64 merely limits the amount of bow that can be placed in the flexible sign element 11 when either being removed or mounted in the sign frame assembly.

FIG. 13 displays an intermediate frame member generally indicated at 66. This is used for forming a frame for supporting more than one sign. The intermediate frame member 66 has a center portion 68 with integral spaced apart upper flanges 52 and lower flanges 54. The intermediate frame member 66 shown in FIG. 13 is in effect two frame members 13 shown in FIG. 11 with the side elements 50 in common with each other. The intermediate frame member 66 is used in sign frame assemblies that are capable of maintaining a plurality of flexible sign elements 11, as best seen in FIG. 14. For this purpose, the inner frame member 66 has two opposing first sign engaging surfaces 22 and two second sign engaging surfaces 23, both second sign engaging surfaces being inclined with respect to the plane of the sign frame assembly as described previously herein. The embodiment of the inner frame member 66 as shown in FIG. 13 shows the first sign engaging surfaces 22 recessed but the sign engaging surfaces 22 may be in the form shown in the embodiments of FIGS. 9 and 10, described previously herein.

The embodiments of the frame members in FIGS. 9 through 13 are preferably integrally made from one piece of material as depicted by the cross-sectional views. Preferably, the frame members are extruded from a metal such as aluminum.

FIG. 14 shows a front elevational view of the sign frame assembly capable of maintaining two flexible sign elements 11, using the embodiments of the frame members in FIGS. 9 through 13. The frame members 13 are fixedly attached at their outer ends to frame members 58 forming the outer periphery of the sign frame assembly. The intermediate frame member 66 is positioned substantially parallel to the frame members 13 and is fixedly attached to the frame member 58 at both ends in such a manner as to accommodate two flexible sign elements 11. Persons skilled in the art will understand that sign frame assemblies may be assembled using the embodiments of the frame members described herein to form sign frame assemblies that are capable of maintaining a plurality of flexible sign elements 11 without departing from the spirit and scope of the present invention.

FIG. 15 shows a sign frame assembly in assembled form using the embodiments of the frame members in FIGS. 10 and 11.

FIG. 16 shows the connecting relationship of the frame member 13 of FIG. 10 and the frame member 58 of FIG. 12, with particular reference to a corner of the sign frame assembly encircled by the line 16 in FIG. 15. The inner flange 64 of the frame member 58 is placed on top of the inner flange 54 of the frame member 13, as shown by the broken lines so that apertures 70 and 72 therein align with each other. The inner surface of side portion 60 of frame member 58 engages an edge of side portion 50 of frame member 13, also shown by broken lines. An appropriate fastener such as a threaded screw type fastener is placed through the aligned apertures 70, 72 to securely hold the now assembled corner of the sign frame assembly. Other fastening means, however, can be used instead of the aligned apertures and the screw threaded fastener such as by welding the ends of the frame members 13 and 58 together. A fastening method such as welding would eliminate one of the functions of bottom flange 54 of frame member 13 and bottom flange 64 of frame member 58 and should not be considered as outside the spirit and scope of the present invention.

FIG. 17 shows still another embodiment of the sign frame assembly of the present invention integrally made from one piece of material. Preferably, the sign frame assembly shown in FIG. 17 is injection molded from a polymeric material such as a thermoplastic. The sign frame assembly in FIG. 17 has third frame portion **13*a* and fourth frame portion 13*b* in a spaced apart relationship and first frame portion 14 and second frame portion 15 also in a spaced apart relationship. The third and fourth frame portions 13*a*, 13*b* have first sign engaging surfaces 20 and second sign engaging surfaces 23 (not shown for frame member 13*a*) and are capable of receiving and retaining the flexible sign element 11** in the same manner as the other embodiments of the sign frame assembly described previously herein.

CONCLUSION

It will be seen that I have provided a unique sign frame assembly which allows a sign to be quickly mounted in a frame in such a manner that unauthorized removal is very difficult. At the same time, it is possible for an authorized person to readily remove the sign. This is accomplished by a construction which is very simple and readily adapted for mass production.

Although the present invention has been described with reference to preferred embodiments, persons skilled in the art will recognize that changes may be made in form and detail without departing from the spirit and scope of the invention.

What I claim is:

1. A front loading multi-sided sign frame assembly for a flexible sign element, comprising:

a plurality of frame portions disposed in a multi-sided manner, two of said frame portions being spaced opposite to each other and each having a first sign engaging surface and a second sign engaging surface contiguous to said first sign engaging surface and inclined with respect thereto, said second sign engaging surface being inclined inwardly with respect to the plane of the sign frame assembly whereby a flexible sign element slightly wider than the distance between the first sign engaging surfaces of said opposed frame portions, when inserted from the front of the frame, is maintained in an inwardly bowed position when engaging the first sign engaging surfaces and overlies the second sign engaging surfaces, at least one of said second sign engaging surfaces having a recess therein which is normally covered by the sign element, said recess being exposed upon deflection of said sign element inwardly in sliding engagement with the second sign engaging surfaces to cause the edges of the sign element normally in abutment with the first sign engaging surfaces to be withdrawn from engagement with at least the one of said first sign engagement surfaces adjacent said recess so as to expose said recess to enable the engagement of the rear of the sign element to provide for the removal thereof.

2. The assembly of claim 1 wherein the inclination of each first sign engaging surface has a maximum angle of approximately 50° with respect to the plane of the sign frame assembly.

3. The assembly of claim 1 wherein the inclination of the second sign engaging surface has an angle of approximately 10° with respect to the sign frame assembly.

4. The assembly of claim 1 wherein said recess is in the form of a narrow niche, said niche being capable of receiving a tool upon being exposed by inward deflection of the sign element.

5. The assembly of claim 1 wherein the frame portions are separate members and are extruded from an extrudable material.

6. The assembly of claim 5 wherein the opposed frame portions each have a side element with spaced apart integral upper and lower flanges protruding therefrom, said side elements and said upper flanges defining the first and second sign engaging surfaces, respectively, and wherein the remaining frame portions each have a side element and an integral lower flange for engaging and being secured to the lower flanges of the opposed frame members when the opposite ends of the frame portions are secured to each other.

7. The assembly of claim 6 wherein the lower flanges of the remaining frame portions limit the distance that the flexible sign element can be bowed inwardly.

8. The assembly of claim 6 wherein the lower flanges of the frame portions are fixedly attached to each other.

9. The assembly of claim 5 wherein the extrudable material is aluminum.

10. The assembly of claim 1 wherein th first sign engaging surface has a portion that forms approximately a 90° angle with the second sign engagng surface, said portion defining the area of the first sign engaging surface that directly engages the flexible sign element.

11. The assembly of claim 10 wherein the sign engaging portion of the first sign engaging surface defines a back wall of a recess, said recess having sides defined by a portion of the second sign engaging surface and a surface substantially parallel to the second sign engaging surface and spaced at least the thickness of the flexible sign element therefrom.

12. The sign frame assembly of claim 1 wherein the other of the frame portions each have a sign element engaging edge to limit the inward deflection of the sign element.

13. The assembly of claim 1 further comprising:

deflection inhibitor means movable into a position preventing further inward bowing of the sign element from the inwardly bowed position; and means for moving said deflection inhibitor into such position for preventing further inward bowing of the sign element.

14. The assembly of claim 13 wherein the deflection inhibitor is mounted in one of the other two frame portions.

15. The assembly of claim 14 wherein the deflection inhibitor comprises:

a shaft journalled in aligned openings on opposite sides of a recess in said one of the other two frame portions;

a cam-like member fixedly mounted on the shaft; and means for holding the cam-like member in an adjusted position.

16. The assembly of claim 1 in which provision is made for mounting a plurality of flexible sign elements, said assembly comprising:

an intermediate frame member secured to said frame assembly and having a first and second sign engaging surface on one side of a center line and a first and second sign engaging surface on the other side of the center line, said sign engaging surfaces corresponding to and facing the sign engaging surfaces of said oppositely disposed frame portions so that a pair of sign elements can be maintained in an inwardly bowed position when engaging the first sign engaging surfaces of the opposite frame portions and the intermediate frame member.

17. The assembly of claim 1 wherein the sign frame assembly is injection molded from a polymeric material.

18. The assembly of claim 1 further comprising mounting means for mounting said sign frame assembly to a supporting surface.

19. A front loading sign assembly comprising:

a multi-sided frame assembly having four frame portions disposed in a multi-sided manner, two of said frame portions being spaced opposite to each other and each having a first sign engaging surface and a second sign engaging surface contiguous to said first sign engaging surface and inclined with respect thereto, said second sign engaging surface being inclined inwardly with respect to the plane of the sign frame assembly, and a flexible sign element of the same configuration as said frame and slightly wider than the distance between the first sign engaging surfaces of said opposed frame portions, said sign element being inserted from the front and engaging the first sign engaging surfaces and overlying the second sign engaging surfaces and being maintained in an inwardly bowed position by said first sign engaging surfaces, at least one of said second sign engaging surfaces having a recess therein which is normally covered by the sign element, said recess being exposed upon deflection of said sign element inwardly in sliding engagement with the second sign engaging surfaces to cause the edges of the sign element normally in abutment with the first sign engaging surfaces to be withdrawn from engagement with at least the one of said first sign engagement surfaces adjacent said recess so as to expose said recess to enable the engagement of the rear of the sign element to provide for the removal thereof.

* * * * *